United States Patent [19]

Baus

[11] 4,321,715

[45] Mar. 30, 1982

[54] WATER CLOSET SPRAYER

[76] Inventor: Heinz G. Baus, Ulmenweg 46, Thun, Switzerland

[21] Appl. No.: 131,009

[22] Filed: Mar. 17, 1980

[30] Foreign Application Priority Data

Mar. 27, 1979 [DE] Fed. Rep. of Germany ..... 2912084

[51] Int. Cl.[3] ..... A61H 35/00; E03D 9/08; F16L 25/00

[52] U.S. Cl. ..... 4/420.2; 4/420.4; 4/443; 4/447; 285/9 R; 285/283

[58] Field of Search ..... 4/443–448, 4/420.1–420.5, 191, 192, 213, 217, 237, 615; 285/283, 9 R, 338, 375, 196

[56] References Cited

U.S. PATENT DOCUMENTS

| | | | |
|---|---|---|---|
| 599,782 | 3/1898 | Harding | 285/9 R |
| 857,519 | 6/1907 | Foster | 285/283 X |
| 1,455,905 | 5/1923 | Cook | 4/420.4 |
| 1,949,415 | 3/1934 | Guidetti et al. | 4/447 |
| 2,104,210 | 1/1938 | Salvoni | 4/445 X |
| 2,774,078 | 12/1956 | Pazos | 4/447 |
| 2,875,450 | 3/1959 | Umann | 4/420.2 X |
| 3,044,076 | 7/1962 | Martini | 4/420.4 |
| 3,227,475 | 1/1966 | Sinkinson | 285/9 R |
| 3,545,015 | 12/1970 | Richardson, Jr. et al. | 4/447 |
| 3,594,826 | 7/1971 | Maury | 4/420.2 |
| 4,069,519 | 1/1978 | Alexander | 4/447 |
| 4,094,023 | 6/1978 | Smith | 4/217 X |
| 4,123,807 | 11/1978 | Oguma et al. | 4/420.2 X |
| 4,208,746 | 6/1980 | Minamoto | 4/420.2 X |

FOREIGN PATENT DOCUMENTS

| | | | |
|---|---|---|---|
| 2124660 | 12/1971 | Fed. Rep. of Germany | 4/443 |
| 2325260 | 12/1973 | Fed. Rep. of Germany | 4/447 |
| 2500345 | 7/1976 | Fed. Rep. of Germany | 4/420.4 |
| 2511692 | 9/1976 | Fed. Rep. of Germany | 4/447 |
| 2702927 | 7/1977 | Fed. Rep. of Germany | 4/447 |

*Primary Examiner*—Stuart S. Levy

*Attorney, Agent, or Firm*—Schwartz, Jeffery, Schwaab, Mack, Blumenthal & Koch

[57] ABSTRACT

An arrangement for washing the lower parts of the body is arranged within the seat of a water closet. The seat (18) is hingedly mounted on a tank (20). Wash water is conveyed from the tank (20) to the seat (18) by means of a line (66) extending through the hinge joint gap (175), which is enclosed by the mutually facing frontal surfaces of the seat (18) and the tank (20). The line (66) is interrupted in the region of the hinge joint gap (175) and terminates on each side of the hinge joint gap (175) in a coupling device. The two coupling devices form a sealed fluid passage when the seat (18) is lowered.

5 Claims, 5 Drawing Figures

Figure 1:
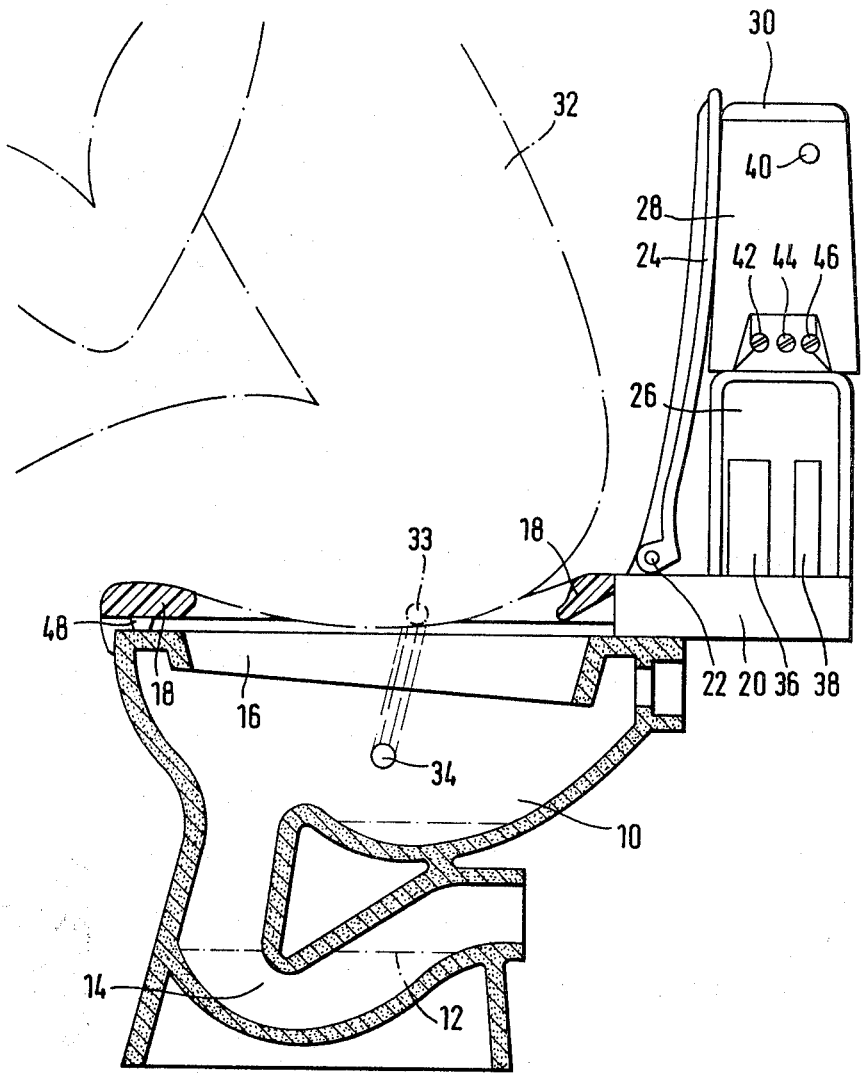

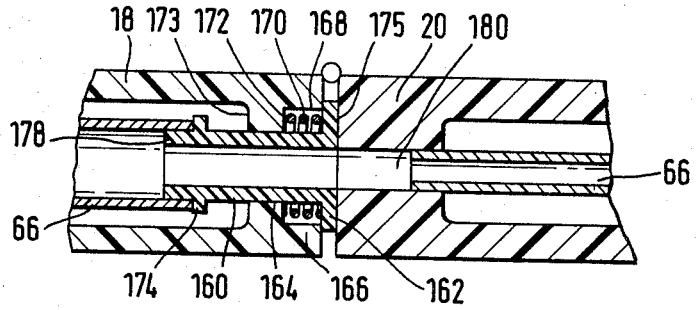
FIG. 3
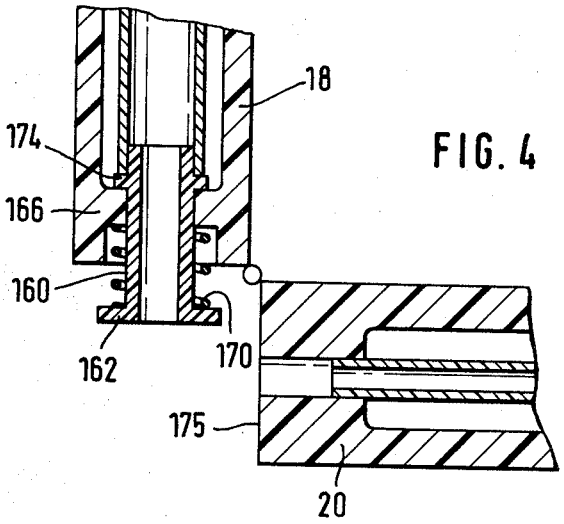
FIG. 4
FIG. 5
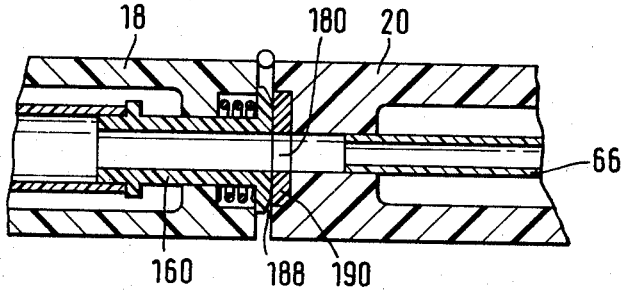

WATER CLOSET SPRAYER

The invention concerns an arrangement installable in the seat of a water closet for washing and drying the lower parts of the body, having a spraying device capable of being rotated into the bowl of the water closet by means of which preheated water may be conveyed to parts of the body to be cleansed, and having a warm air blower actuated after the completion of the spraying and cleansing process. The spraying device has at least one spray nozzle, mounted in a downwardly open cavity in the seat and rotatable inwardly by means of a hydraulic or pneumatic actuating device which includes a piston-cylinder arrangement, so that in its rest position the spraying device is located within the cavity and in its outwardly rotated position is located off the center of the closet bowl. Pipes connect the piston-cylinder arrangement with a control valve regulating the hydraulic fluid (water) and connect the spraying device with a continuous flow heater.

Water closet installations are known in which spraying devices are provided for cleansing the lower parts of the body with warm water and for subsequently drying the same with warm air. Such devices are located either in the seat or toward the rear in the area of the hinge or of the water tank, and are mounted in a stationary manner. (See: U.S. Pat. No. 2,875,450). It is further known (DE-OS No. 21 24 660), to mount the spraying device and the drying installation between the seat and the rim of the water closet in the vicinity of the hinge. In these installations, the spray nozzle is mounted essentially in a stationary manner and is not rotatable into the region occupied by the body. In the arrangement according to U.S. Pat. No. 3,545,015, the spray nozzle is underneath the rim of the bowl and is likewise installed in a stationary manner.

In these known devices, supplying water to the spraying device is relatively simple, because it is not necessary to pass the water supply lines through the area of the hinge where they would be exposed to frequent bending stresses.

An arrangement is shown in DE-OS No. 2 325 260 in which the spray nozzle is connected with the upwardly tiltable seat. The fact that a portion of the water supply line is located in the area of the stationary lower tank and the other portion in the area of the seat, presents a problem which is solved by providing a rotatable seal in the vicinity of the hinge, by means of which the water is supplied to the nozzle via a T-shaped intermediate piece. Aside from the fact that the installation is relatively involved, there is also the problem that because of the frequent tilting movements of the seat, the seals will become leaky in the course of time, allowing water to escape at the seals.

DE-OS No. 25 00 345 also discloses a spraying device attached to the seat. However, there is no mention of the water supply problem.

It is therefore the object of the invention to provide apparatus of the type described above which may be attached to a water closet seat for washing the lower parts of the body, wherein the problem of supplying water to the spraying device (and if necessary for a hydraulic or pneumatic piston-cylinder arrangement) is solved in a satisfactory manner. In particular, the mounting of the supply line is to be simplified and sealing problems, such as those occuring with rotatable seals, avoided.

The object is attained acording to the invention in that each tubular line is interrupted in the region of the hinge joint gap and terminates in a coupling device on either side of the hinge joint gap, and that in the lowered position of the seat, the two coupling devices form a sealed flow passage.

In an advantageous embodiment of the invention, a tube section is provided in the area of the hinge joint gap, resiliently biased outwardly from the seat, this tube section having an outer front face formed as a sealing surface which abuts the tank on which the seat is hinged when the seat is lowered, sealingly surrounding the water supply orifice and thereby forming the coupling arrangement.

In a preferred embodiment of the invention, the tube section has a flange outwardly of the seat, with a compression spring located between the seat and the flange, and the tube section within the seat has a collar which is preferably spreadable to limit the motion of the tube section under the action of the spring.

The coupling arrangement according to the invention provides an easily installable and optimally effective seal between the sections of the supply lines movable with respect to one another.

The invention shall be explained in more detail with the aid of the drawings, in which embodiments of the invention are illustrated.

Figure 2:
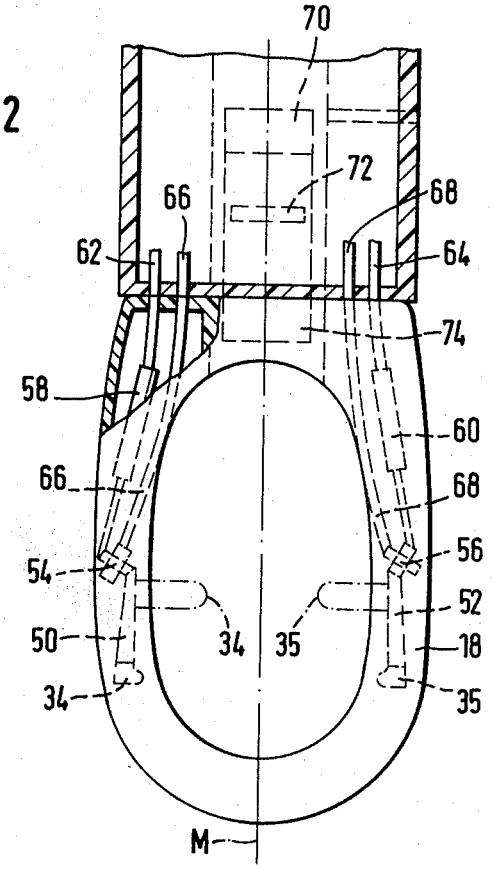

In the drawings,

FIG. 1 shows a schematic representation of the water closet in cross section, FIG. 2 a top view of the water closet, FIGS. 3 and 4 a cross section through the seat and the mounting tank located beneath the water tank, showing a line coupling, with a lowered seat cover (FIG. 3) and with a raised seat cover (FIG. 4), and FIG. 5 a cross section through the seat similar to that of FIGS. 3 and 4, for a further embodiment of the invention.

FIG. 1 shows a schematic diagram of a water closet with a bowl 10 and a liquid trap 12 containing water 14. Above the rim of the bowl 16 is a seat 18, which is hingedly attached to the tank 20 by means of a hinge, not shown. A lid 24 is hingedly attached above the tank 20 by means of a further hinge 22. Behind lid 24 is a lower part 26 of the tank and, therabove, the water tank 28. The latter is closed by means of a cover 30. The symbol 32 indicates the outlines of a person seated on the seat 18; the anal region of the person is cleansed by means of a spray nozzle 34. Inside the lower tank part 26, is a block 36 for controlling certain processes to be described hereinafter, and a continuous flow heater 38; a lateral wall of the lower part of the tank is removed to render the block 36 and the continuous flow heater 38 visible. The flusing process for the rinsing of the closet is actuated by means of a flushing knob 40. On the water tank 28, three rotatable knobs 42, 44 and 46 are visible from the outside, by means of which the washing and drying cycles may be adjusted. Because the washing and drying processes are controlled electronically or electrically, a switch must be provided to actuate the installation; this is the switch 48, arranged beneath the seat between the upper edge of the bowl rim 16 and the seat 18 and actuated by the weight of the seated person 32.

FIG. 2 shows a top view of the water closet according to FIG. 1, with seat 18 lowered, cover 24 eliminated and certain parts broken away.

The spray nozzles 35 are arranged on the two longer inner sides of the oval seat 18. Each spray nozzle 34, 35 is mounted on a respective swivel arm 50, 52, which in turn is pivotably mounted on the seat 18 in a respective bearing element 54, 56 and which is actuated by means of a respective piston-cylinder arrangement 58, 60.

In FIG. 2, the spray nozzles 34 and 35 are shown in broken lines in their rest position (beneath seat 18) and in their position rotated into the bowl 10 (off the center line M of the bowl 10).

Both piston-cylinder arrangements 58, 60 are actuated with water; the water is supplied to them by way of control valves, not shown, and respective lines 62, 64.

The spray nozzles 34, 35 are supplied with water by means of respective lines 66, 68, as shall be explained in more detail below. The continuous flow heater 38 shown in FIG. 1 is connected with lines 66 and 68, so that the water being sprayed is maintained at room temperature. By means of appropriate control devices, adjustable by rotating knobs 42 to 46, the temperature of the water supplied may be varied.

Following the completion of the flushing and the spraying processes, a fan 70 is actuated for blowing air heated by a heat source 72 or an infrared lamp through a supply channel 74 and into the bowl 10, so that the drying process in the anal region may be effected. The four lines 62, 64, 66, 68 passing through the hinge joint gap 175 are subjected to frequent bending and tensile stresses during the raising and lowering of the seat 18 so that there is a danger of their rupturing in this region. For this region, the lines 62, 64 and 66, 68 are interrupted in the area of the hinge joint gap 175 and replaced by a suitable coupling piece. The coupling piece for the interrupted portion of the line 66 is shown in FIGS. 3 and 4; the coupling piece is similarly constructed for the other lines 62, 64, 68. It consists of a tube section 160, provided with a radial flange 162 in the outward direction i.e. in the region of the hinge joint gap. The tube section 160 extends through an orifice 164 provided in a rear limiting wall 166 of the hinge joint gap. The rear wall 166 has an enlargement 168 in the region of the hinge joint gap which is open toward the hinge joint gap, with a spring 170 arranged between the flange 162 and the floor 172 of the enlargement 168. Within the seat 18 and spaced from the inner surface 173 of the rear wall 166, the tube section 160 has a nose 174 on both sides, which is illustrated in the drawing as a radially protruding flange, but which in reality is an expanding nose, so that the tube section 160, made of a synthetic plastic material, may be inserted through the orifice 164 from the outside inwardly. Tube section 160 extends beyond the expanding nose into a terminal portion 178, to which the free end of the tubular line 66, located within the seat 18, may be fastened. An orifice 180 is provided in the tank 20 which, when seat 18 is lowered, is aligned with the tube section 160 and receives the portion of line 66 located in tank 20.

FIG. 4 shows the arrangement according to FIG. 3, but with the seat 18 raised. It can be seen that the tube section 160 is biased outwardly under the pressure of the spring 170, until the nose 174 comes to rest against the inner surface 173 of the rear wall 166. When the seat 18 is lowered, the flange 162 abuts the surface of the tank 20 defining the hinge joint gap 175 and in this manner seals the coupling. In order to assure adequate sealing in the hinge joint gap 175, the spring 170 must be sufficiently strong; it is obviously also possible to arrange an annular sealing nose in the flange 162 to provide connection with the surface of the tank 20.

When the seat is raised, the tube section 160 is biased outwardly by the spring 170. This path is so dimensioned that the flange 162 cannot be jammed against the surface 175 facing the seat 18. It is further possible to round off the flange 162 on the frontal surface thereof which serves as a sealing surface, to facilitate its sliding onto the counter surface 175 on the tank 20 and to obtain increased sealing force by virtue of the reduced sealing area.

According to FIG. 5, the front surface 188 of the tube section 160 is rounded. An approximately annular sealing element 190 which also serves as a sliding surface is provided on the lateral opposing surface of the tank 20; it surrounds the orifice 180 and cooperates with the rounded frontal surface 188. This improves the sliding in of the tube section 160 as well as the sealing effect.

List of the Reference Symbols

| | | | |
|---|---|---|---|
| 10 | water closet bowl | 160 | tube section |
| 12 | liquid trap | 162 | flange |
| 14 | water in trap | 164 | orifice |
| 16 | rim of bowl | 166 | rear wall |
| 18 | seat | 168 | enlargement |
| 20 | tank | 170 | spring |
| 22 | hinge | 172 | floor |
| 24 | lid | 173 | inner surface |
| 26 | lower part of tank | 174 | nose |
| 28 | water tank, water container | 175 | hinge joint gap |
| | | 178 | terminal portion |
| 30 | cover | 180 | orifice |
| 32 | person | 188 | frontal surface |
| 33 | anal region | 190 | sealing element |
| 34, 35 | spray nozzle | M | center line |
| 36 | block | | |
| 38 | continuous flow heater | | |
| 40 | flushing knob | | |
| 42, 44, 46 | rotatable knobs | | |
| 48 | switch | | |
| 50, 52 | swivel arm | | |
| 54, 56 | bearing element | | |
| 58, 60 | piston-cylinder arrangement | | |
| 62, 64 | hose, line | | |
| 66, 68 | hose, line | | |
| 70 | fan, blower | | |
| 72 | heat source | | |
| 74 | air channel | | |

I claim:

1. An arrangement installable in the seat (18) of a water closet for washing and drying the lower parts of the body, having a spraying device rotatable into the closet bowl (10), by means of which preheated water may be conveyed to the parts of the body to be cleansed, and having a warm air blower (70) to be actuated following the completion of the spraying and cleansing process, wherein the spraying device comprises at least one spray nozzle (34, 35) mounted within a downwardly open cavity in the seat (18) and pivotable inwardly by means of a hydraulic or pneumatic actuating device comprising a piston-cylinder arrangement (58, 59), so that in its rest position said spraying device is located within the cavity and in its outwardly rotated position said spraying device is located off the center of the closet bowl, said seat being mounted on said water closet by means of a hinge such that a hinge joint gap (175) is formed between said seat and said water closet; and wherein tubular lines (62, 64, 66, 68) connect the piston-cylinder arrangement (58, 60) with a control valve for regulating the hydraulic fluid and the spraying device with a continuous flow heater (38), characterized in that each flexible line (62, 64, 66, 68) is divided at the hinge joint gap (175) and terminates in a coupling device at each side of the hinge joint gap (175) and that the two coupling devices form a sealed fluid passage when the seat (18) is lowered.

2. Arrangement according to claim 1 characterized in that a tube section (160) biased (170) outwardly of the seat (18) is located in the seat (18) in the area of the hinge joint gap (175), having an outer frontal surface designed as a sealing surface which abuts the tank (20) when the seat (18) is lowered and which sealingly surrounds the water supply orifice (180) of said tank (20), thus forming the coupling device.

3. Arrangement according to claim 1, characterized in that the tube section (160) is provided outside the seat (18) with a flange (162), while a compression spring (170) is located between the seat and the flange, and in that the tube section has a spreadable collar (174) inside the seat (18) for limiting the motion of the tube section caused by the pressure of the spring.

4. Arrangement according to one of claims 1 to 3, characterized in that the frontal surface (188) of the tube section (160) facing the tank (20) is rounded in a convex configuraton.

5. Arrangement according to one of claims 1 to 3, characterized in that an annular sealing element (190) is provided at the frontal surface of the tank (20) facing the seat (18), said sealing element surrounding the orifice (180) and sealingly cooperating with the frontal surface of the tube section (160).

* * * * *